United States Patent [19]

McFarlane

[11] Patent Number: 4,700,781

[45] Date of Patent: Oct. 20, 1987

[54] HEAVY CRUDE OIL PRODUCTION TOOL AND METHOD

[76] Inventor: Reuben C. McFarlane, P.O. Box 11, Elkhart, Tex. 75839

[21] Appl. No.: 806,445

[22] Filed: Dec. 9, 1985

Related U.S. Application Data

[63] Continuation-in-part of Ser. No. 523,706, Aug. 16, 1983, abandoned.

[51] Int. Cl.[4] ..... E21B 43/24

[52] U.S. Cl. ..... 166/303; 166/57; 166/372

[58] Field of Search ..... 166/57, 303, 265, 369, 166/372, 374; 299/6, 17

[56] References Cited

U.S. PATENT DOCUMENTS

| | | | |
|---|---|---|---|
| 1,886,886 | 11/1932 | Kelley et al. | 166/265 |
| 2,881,838 | 4/1959 | Morse et al. | 166/303 |
| 3,386,508 | 6/1968 | Bielstein et al. | 166/303 X |
| 4,046,199 | 9/1977 | Tafoya | 166/303 |
| 4,299,278 | 11/1981 | Beehler | 166/303 X |
| 4,421,163 | 12/1983 | Tuttle | 166/303 X |
| 4,537,254 | 8/1985 | Elson et al. | 166/303 X |

*Primary Examiner*—Stephen J. Novosad

[57] ABSTRACT

A method to recover subsurface heat-liquefiable minerals and viscous oil by jetting steam through orifices set adjacent to subsurface formations and deposits. The steam heat reduces the flow resistance of the mineral or oil and allows the resulting liquid to be removed to the surface by conventional pumping means at any point along the vertical interface of the single well bore and formation or deposit. Removal of the resulting liquid may also be accomplished through the apparatus itself.

3 Claims, 2 Drawing Figures

HEAVY CRUDE OIL PRODUCTION TOOL AND METHOD

CROSS-REFERENCE TO RELATED APPLICATION

This application is a continuation-in-part of application Ser. No. 523,706, filed Aug. 16, 1983, now abandoned.

| CROSS-REFERENCES CITED: | | | |
|---|---|---|---|
| 1,432,649 | 10/17/1922 | Wessels | 166/57 |
| 1,705,848 | 3/19/1929 | Austin | 166/235 |
| 1,835,400 | 12/08/1931 | Ingison et al | 166/60 |
| 2,672,239 | 3/16/1954 | Baril | 210/186 |
| 2,911,047 | 11/03/1959 | Henderson | 166/61 |
| 3,113,623 | 12/10/1963 | Krueger | 166/59 |
| 3,160,208 | 12/08/1964 | Jorda | 166/57 |
| 3,618,767 | 11/09/1971 | Thummel | 210/186 |
| 3,620,300 | 11/16/1971 | Crowson | 166/60 |
| 3,620,571 | 11/16/1971 | Billings | 166/57 |

STATEMENT AS TO RIGHTS TO INVENTIONS MADE UNDER FEDERALLY-SPONSORED RESEARCH AND DEVELOPMENT

There is no Federally-sponsored research and development for this invention.

BACKGROUND OF THE INVENTION

1. Field of the Invention

The McFarlane Heavy Crude Oil Production Tool is a method to recover liquefiable minerals and oil, particularly heavy crude oil, from subsurface deposits and formations. The invention allows the heating of the subsurface deposit or formation with steam. The resulting heat, lowers the viscosity of the substance being extracted and thereby increases yield utilizing a single well or multiple wells.

2. Description of the Prior Art

Other methods to recover viscous subsurface minerals and oil, generally required a large amount of surface equipment. This was expensive because of the amount of equipment needed, the difficulty of setting up the process at each site, and the large associated operation and maintenance expenses. Such methods are fire flood, steam injection, and water flood.

In about 1959, Henderson developed a process (U.S. Pat. No. 2,911,047) to recover difficulty flowable petroleum oil from subterranean bodies. In this process, heat was transfered by a coil that was placed in interface with the subterranean body and then pumped conventionally. The process was limited due to its inability to heat only the small area of actual contact between the device coils and the petroleum oil. Also, in about 1954, Baril had developed a similiar process using simple heat exchange and filters, it had the same inability as Henderson's process. Other processes involved moving or rotating disks, at formation depths, that required removal upon malfunction.

In about 1971, Billings utilized steam and a fuel mixture to increase the heated area of the subsurface formation. Billings process did not allow for a conventional pump unit to extract the heated liquid. All production was made through the Billings device, and therefore was limited in production. When a malfunction occurred, all production stopped and the difficult removal of the apparatus had to be done immediately.

SUMMARY OF THE INVENTION

The McFarlane heavy crude oil production tool, hereinafter referred to as tool, provides for increased production by allowing the ready removal of heat-liquefiable minerals and oil from subsurface deposits and formations. The tool is placed in the well bore directly below a conventional pump unit. Steam is introduced into the bottom of the tool from a standard steam unit which is mounted at the surface. The steam is allowed to pressurize within the tool by the use of a closed surface mounted valve. Steam may be at temperatures up to 500 degrees F. and at pressures up to 2000 psi. These are the specific limitations of the apparatus, along with its inability to be utilized in wellbores in excess of 3000 feet in depth. The steam travels through the tool's filters and is jetted into the formation, or deposit, through orifices located on the exterior of the tool. After the formation or deposit is adequately heated, the liquefiable mineral, or oil, enters the screen and liner of a conventional pumping unit. Here the heated mineral or oil, and residual water from the process, are pumped to the surface.

If the pressure to the tool is relieved by opening the surface mounted valve, the heated mineral, or oil, and process water will enter the tool through the orifices and filters and be transported to the surface to storage.

The McFarlane heavy crude oil production tool utilizes one borehole, a conventional pumping unit, a storage tank, and a conventional steam unit.

The McFarlane heavy crude oil production tool overcomes many previous problems. The tool utilizes steam that is actually forced into the subsurface formation or deposit and heats up a large volume of the formation or deposit. The heated liquid, with reduced viscosity, is then removed by a conventional pumping unit and/or directly through the McFarlane heavy crude oil production tool. The result is increased production.

In the event of a malfunction, standard production can still be maintained through the conventional pumping unit, screen, and liner. The tool does not have electrical or mechanical moving parts in the well bore. The filter system helps maintain working pressure and prevents clogging when the system is not under pressure.

BRIEF DESCRIPTION OF DRAWINGS

The McFarlane heavy crude oil production tool is better understood by reference to the accompanying drawings.

DESCRIPTION OF THE PREFERRED EMBODIMENTS

Figure 1:
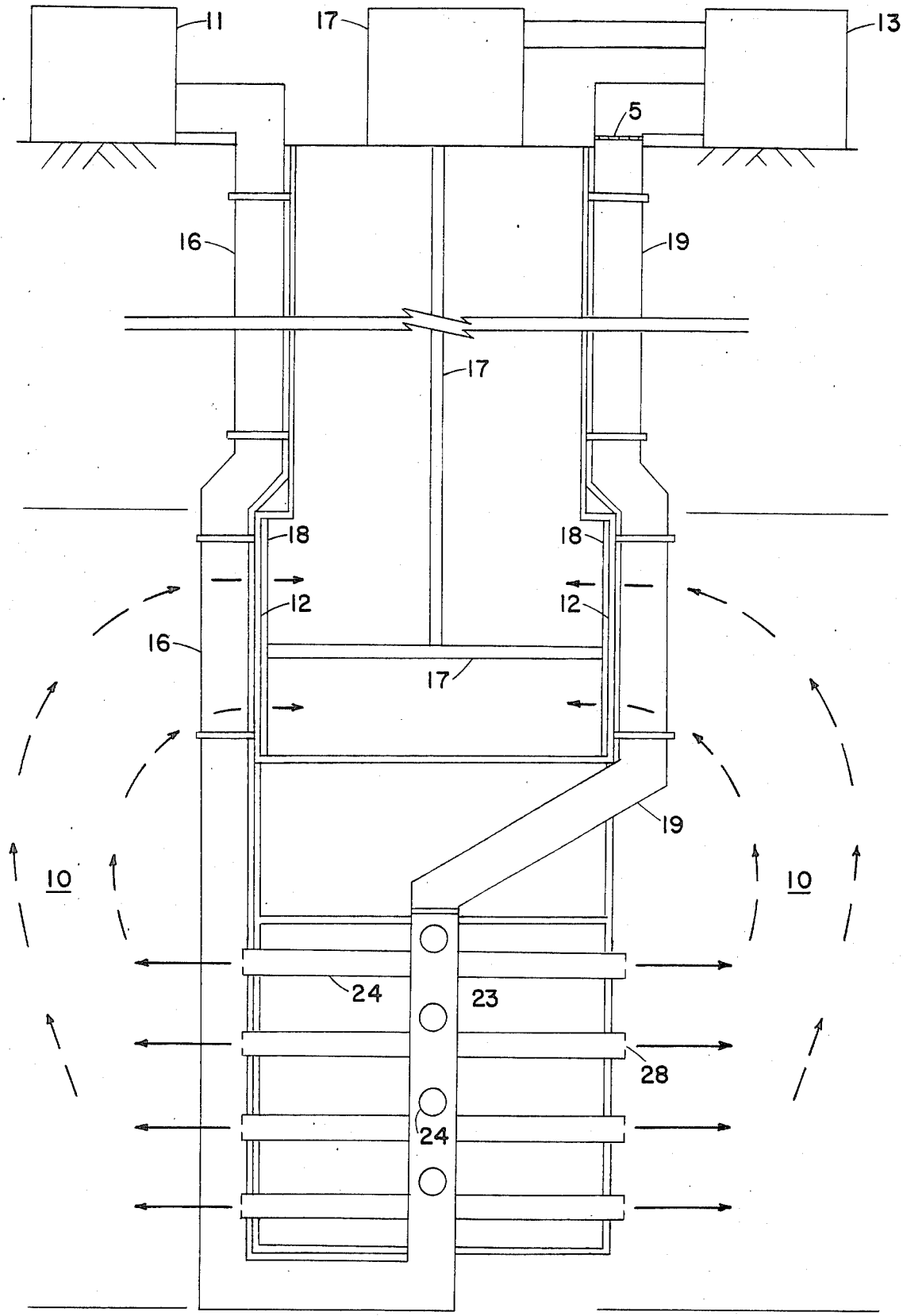
FIG. 1 is an illustration of the invention, arranged to conduct the process in conjunction with conventional equipment including the steam unit, pumping unit, and storage tank. The arrangement illustrates the steam being introduced into the subsurface formation or deposit and heat-liquefied mineral or oil being transported to the surface.

Referring to FIG. 1, the conventional equipment maintained at the surface typically includes a steam unit 11, a pump unit 17, and storage tank 13. This equipment is not part of the McFarlane heavy crude oil production tool, called tool below, but necessary for the process to take place. The steam unit 11, supplies heated and pressurized steam to the bottom of the tool by way of line 16. Pressure is maintained within the tool by closing valve 5 at the surface, which prevents pressure and steam loss to the atmosphere.

Figure 2:
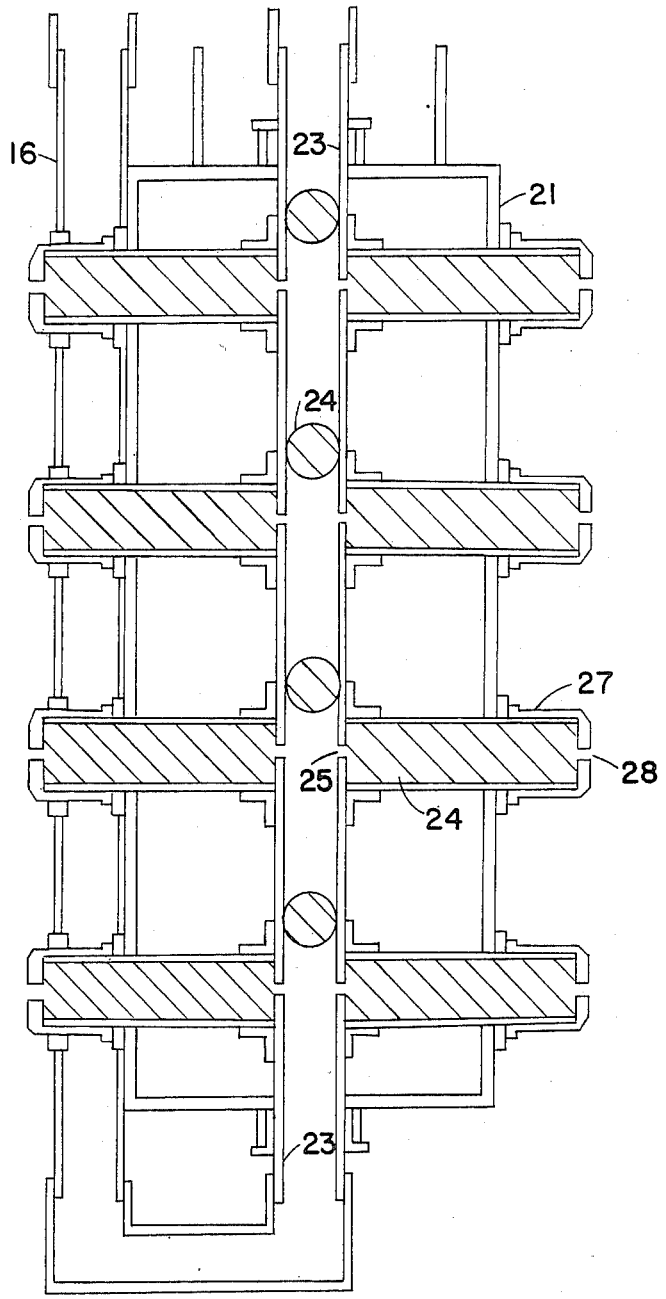
FIG. 2 is a detailed drawing of the equipment of the invention including piping, filters, orifices, and enclosing case to illustrate the arrangement of the invention.

Referring now to the tool arrangement in FIG. 2, pressurized steam enters the tool by tubing 23. Steam under pressure is transported from tubing 23 through internal orifices 25, of which there are eight pairs. Each pair of internal orifices 25 allows steam to enter the filters 24. There are two sets of four filters, with each set at a 90 degree angle from the other. The steam passes through filters 24 and out of the external orifices 28. The external orifices 28 are made in a cap 27 which protrudes slightly from the case 21 of the tool.

Now referring to FIG. 1, as the steam leaves the tool through external orifices 28, as shown by solid arrows, the adjoining formation, or deposit 10 is heated. The heat-liquefied mineral or oil flows, as shown by dashed arrows, through the conventional pumping unit screen 12 and liner 18, where it is transported to the surface by pumping unit 17 into storage tank 13. After a sufficient heating time of formation or deposit 10, valve 5 at the surface can be opened to relieve pressure and thus allow the liquid contained in the formation or deposit 10, to enter the tool through external orifices 28 of the tool. Referring to FIG. 2, the liquid passes through the filters 24 and orifices 25, where it enters tubing 23. Now referring to FIG. 1, the liquid is transported to the surface into storage tank 13 by way of line 19.

The tool having now been particularly described, specifically with reference to the illustrated embodiments, it will be apparent to those skilled in the art, that the number and size of the filters 24 and related orifices 25 and 28, as well as the spacing between them, can be varied to compliment a particular application.

Furthermore, it will be obvious that multiple tools may be stacked in series to effect adequate heat-liquefication of the mineral or oils. Also, the use of single and multiple well bores with the tool, are intuitively obvious.

What is claimed is:

1. The method of extracting subterranean oil deposits from a borehole, comprising the steps of:

establishing a tube arrangement, which contains a set of orifices and filter means for each of said orifices, in said borehole, adjacent to an oil bearing formation;

placing an independently operating pumping means in said borehole directly above said tube arrangement;

adding steam from an above ground source;

pressurizing said steam down through the said tube arrangement, through said filter means, and out of said orifices to heat the said oil bearing formation;

causing the heated oil, from said oil bearing formation, to flow to the said independently operating pumping means during said steam pressuring step;

causing the said heated oil to be delivered to the ground surface; and further allowing said heated oil to enter through said orifices and pass through said filter means by regulating the pressure of the said steam; and allowing the said heated oil to be delivered to the ground surface by way of the said tube arrangement, by the said pressure of the steam.

2. The method of claim 1 wherein said steam is continually applied through said orifices during said heated oil removal by the said independently operating pumping means.

3. The method of claim 1 wherein the steps of said method are carried out in multiple well bores.

* * * * *